US006351860B1

(12) United States Patent
Schaffer

(10) Patent No.: US 6,351,860 B1
(45) Date of Patent: Mar. 5, 2002

(54) BATHTUB CHAIR LIFT

(76) Inventor: Richard C. Schaffer, 3920 W Vickery, Fort Worth, TX (US) 76107

( * ) Notice: Subject to any disclaimer, the term of this patent is extended or adjusted under 35 U.S.C. 154(b) by 0 days.

(21) Appl. No.: 09/818,287

(22) Filed: Mar. 27, 2001

(51) Int. Cl.[7] ..... A47K 3/02
(52) U.S. Cl. ..... 4/563.1; 4/560.1; 4/566.1
(58) Field of Search ..... 4/560.1–566.1, 4/584

(56) References Cited

U.S. PATENT DOCUMENTS

| | | | | | |
|---|---|---|---|---|---|
| 3,381,317 | A | * | 5/1968 | Daniels | 4/563.1 |
| 3,815,163 | A | * | 6/1974 | Sullivan | 4/563.1 |
| 4,569,091 | A | * | 2/1986 | Brandenberger | 4/563.1 |
| 5,129,112 | A | | 7/1992 | Schaffer | |
| 5,839,131 | A | | 11/1998 | Schaffer | |

* cited by examiner

*Primary Examiner*—Gregory L. Huson
*Assistant Examiner*—Tuan Nguyen
(74) *Attorney, Agent, or Firm*—Arthur F Zobal; Geoffrey A Mantooth

(57) ABSTRACT

The chair lift is formed by a hollow outer stationary cylinder secured to the bathtub and an inner cylinder having a closed upper end secured to the bathtub located inside and spaced from the outer cylinder. A hollow movable cylinder having a closed upper end is slidably located between the inner and outer cylinders forming a chamber between the inner and moveable cylinders. A water control system including a pump is provided for injecting water into the chamber for moving the movable cylinder to an upper position and for removing water from the chamber to allow the movable cylinder to move to a lower position. The outer cylinder has a vertical slot formed through its wall. A chair has a connection that extends through the slot and is connected to the movable cylinder for moving the chair to upper and lower positions with the movable cylinder.

4 Claims, 4 Drawing Sheets

BATHTUB CHAIR LIFT

BACKGROUND OF THE INVENTION

1. Field of the Invention

The invention relates to an apparatus for allowing a person to easily enter and leave a bathtub.

2. Description of the Prior Art

U.S. Pat. Nos. 5,129,112 and 5,839,131 each disclose a bathtub with a chair lift for allowing a person to enter and leave the bathtub.

SUMMARY OF THE INVENTION

It is an object of the invention to provide a chair lift for a bathtub that has increased stability and a fluid operated system that can readily lift the chair from a lower position to an upper position.

In the preferred embodiment, the chair lift comprises a hollow outer stationary cylinder and an inner stationary cylinder having a closed upper end secured to the bathtub located inside and spaced from the outer cylinder. A hollow movable cylinder having a closed upper end is slidably located between the inner and outer cylinders forming a chamber between the inner and movable cylinders. A water control means is provided for injecting water into the chamber for moving the movable cylinder to an upper position and for removing water from the chamber to allow the movable cylinder to move to a lower position. The outer cylinder has an elongated slot formed through its wall extending between upper and lower positions. A chair is provided which has a connection means that extends through the slot and is connected to the movable cylinder to allow the movable cylinder to move the chair to an upper position relative to the bathtub and a lower position in the bathtub.

In the embodiment disclosed, the water control means comprises a pump having an inlet coupled to a source of water and an outlet coupled to the chamber for injecting water into the chamber.

DESCRIPTION OF THE PREFERRED EMBODIMENTS

Figure 1:
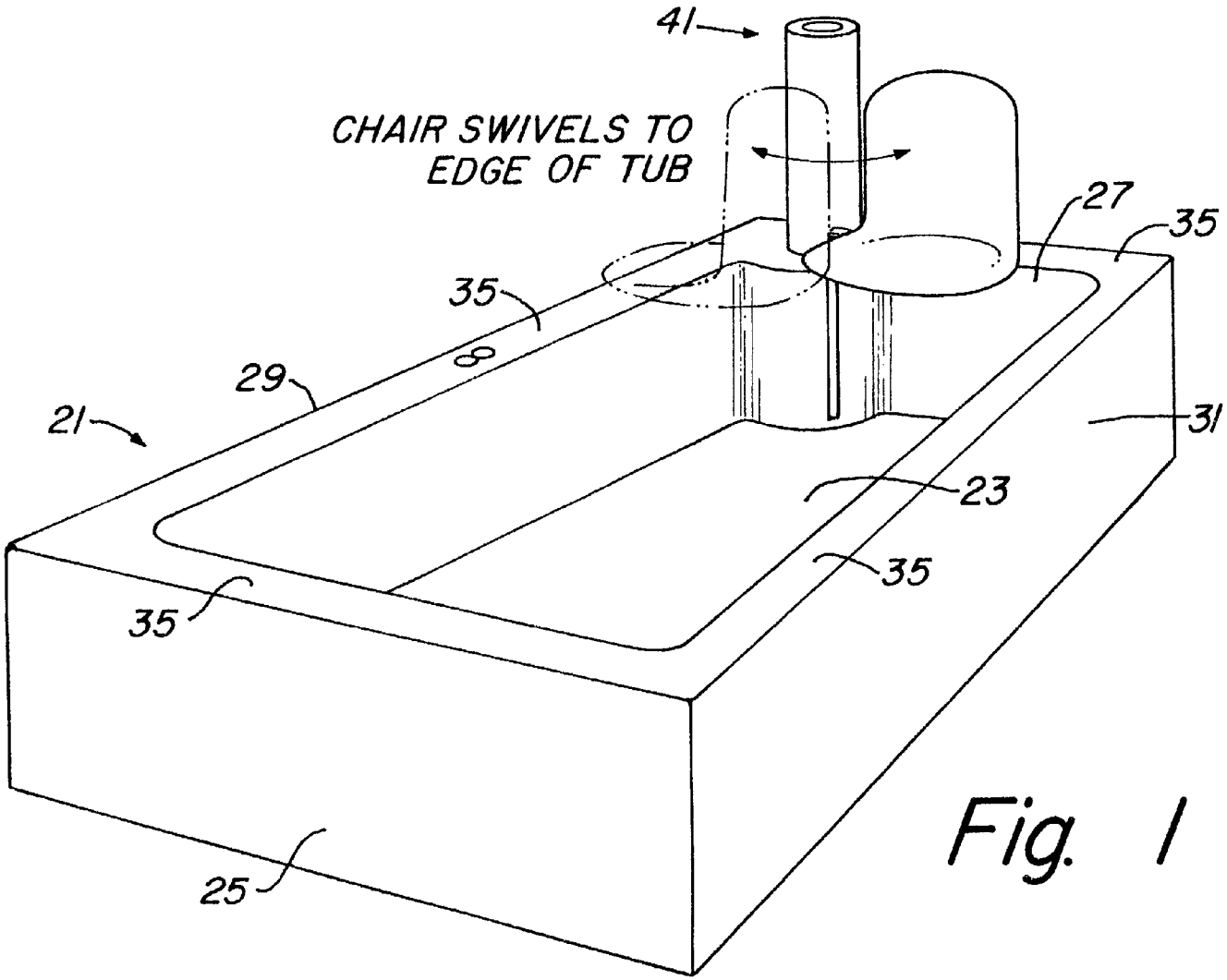
FIG. 1 is a perspective view of the chair lift of the invention in a bathtub.

Referring now to the drawings, there is illustrated a bathtub 21 having a bottom 23, two opposite ends 25 and 27 and two sides 29 and 31 forming an interior cavity 33 for holding water. The ends 25 and 27 and sides 29 and 31 have upper edges 35 all at the same level. The bathtub 21 may be formed of a suitable plastic material.

A hollow cylinder 41 comprising a cylindrical wall 41W has a lower portion 41L attached or molded into the wall structure 21W of one corner of the inside of the bathtub 21. The cylinder 41 has an upper portion 41U extending upward above the edges 25. The top end of the cylinder 41 has an upper wall 43 with an opening 45 formed therethrough. A vertical slot 41S is formed through the wall 41W on the side facing the interior 33 of the bathtub 21. The slot 41S extends from a position near the bottom 23 to a position near but above the upper edge 35.

A stationary hollow inner cylinder 51 is located inside the outer cylinder 41 and spaced inward therefrom. The cylinder 51 has its lower end 51L attached to the wall structure 21W of the bathtub. An annular space 53 is formed between the inner side of the outer cylinder 41 and the outer side of the inner cylinder 51. The inner cylinder 51 has an upper wall 55 extending across its upper end with a small central aperture 57 extending therethrough. An annular seal 59 is attached to the upper side of the wall 55. The annular seal 59 has a central aperture 61 formed therethrough.

Figure 3:
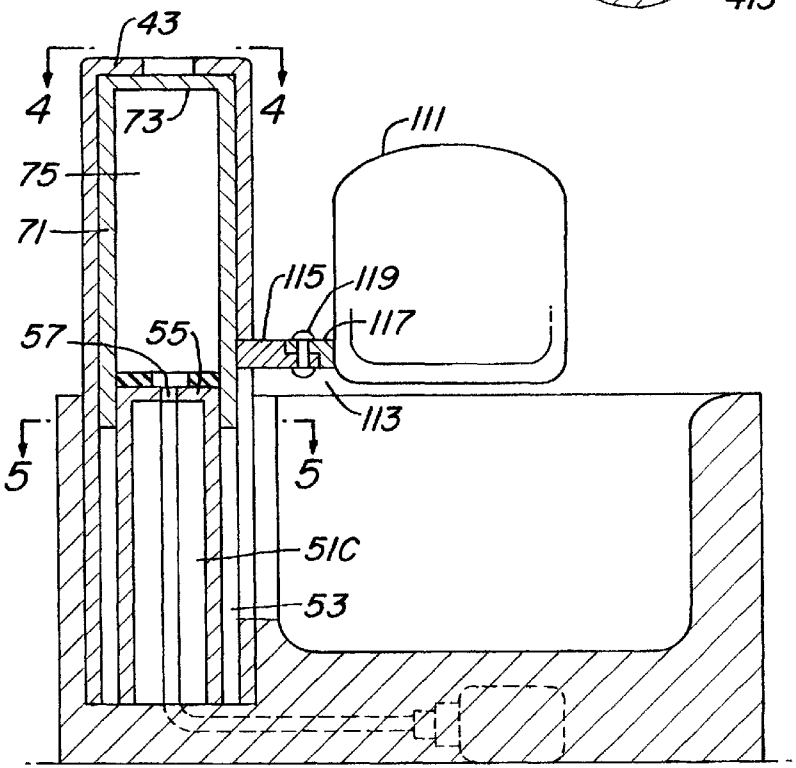
FIG. 3 is a cross-sectional view of FIG. 2 as seen along lines 3—3 thereof and with the movable cylinder and chair in upper positions.
Figure 4:
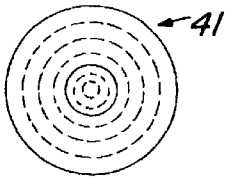
FIG. 4 is a view of FIG. 3 as seen along lines 4—4 thereof.
Figure 6:
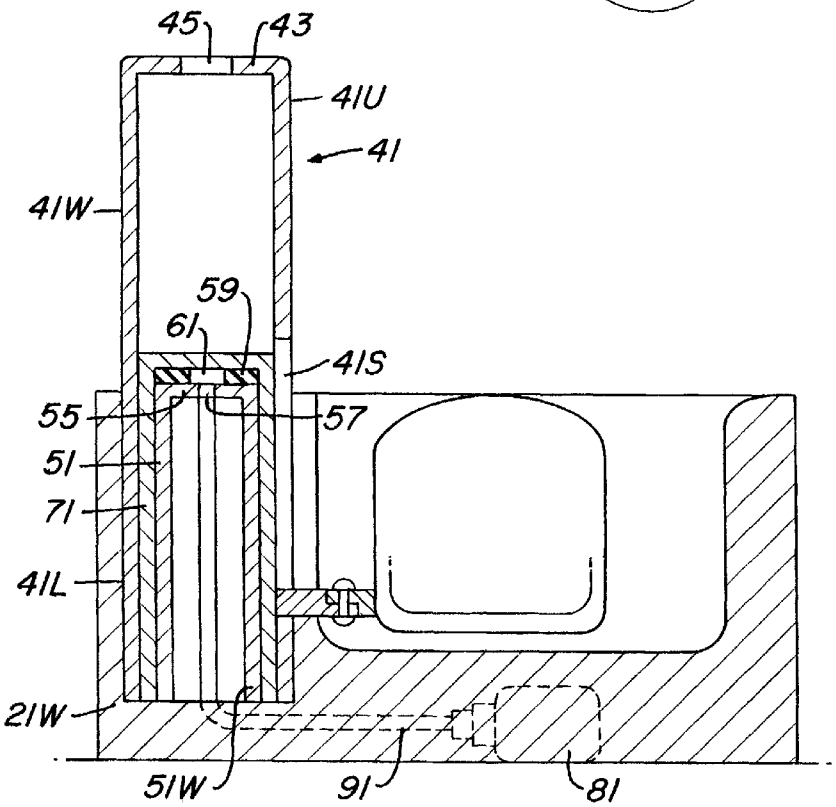
FIG. 6 is a view similar to that of FIG. 3 but with the movable cylinder and chair in lower positions.

Slidably located in the annular space 53 between the outer and inner cylinders 41 and 51 is a hollow cylinder 71 having a wall 73 extending across its upper end such that the cylinder 71 has a closed upper end. The cylinder 71 can extend between its lower position as shown in FIG. 6 to an upper position as shown in FIG. 3 which engages the wall 43 such that a variable volume chamber 75 is formed between the top of inner cylinder wall 55 and seal 59 and the inside of the cylindrical wall 71 and the inside of its upper wall 73.

Figure 7:
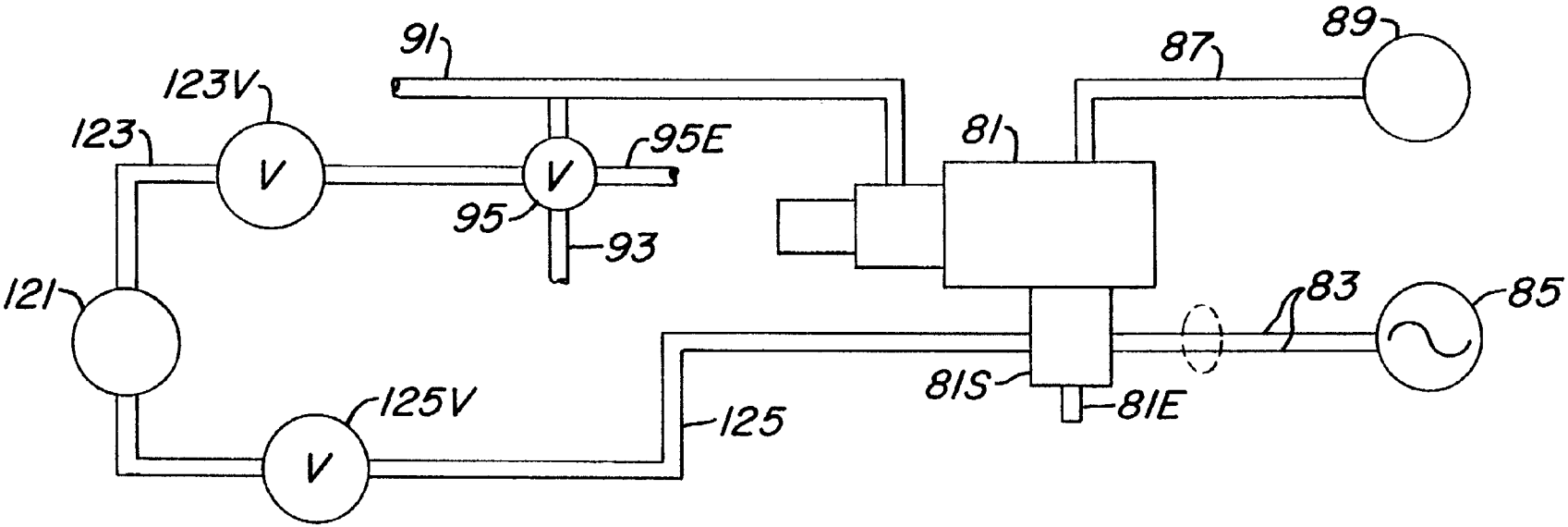
FIG. 7 illustrates a control system for the bathtub lift.

Referring also to FIG. 7, an electric water pump 81 operated from AC power obtained from leads 83 coupled to an AC source 85 is coupled to the bathtub 21 and has an inlet tube 87 coupled to a source of water 89 and an outlet tube 91 extending up the central space 51C of the inner cylinder 51 through the aperture 57 of the upper wall 55 of the cylinder 51 into the aperture 61 of the seal 59. A drain tube 93 is coupled to the tube 91 by way of normally closed valve 95.

When the pump 81 is operated, it pumps water from the source 89 through the tube 91 into the chamber 75 to move the movable cylinder 51 upward until it engages the upper wall 43 of the cylinder 41 at which time the pump 81 is shut off. In order to lower the cylinder 51, the drain valve 95 is opened to allow the water in the chamber 75 to drain into the bathtub.

Figure 2:
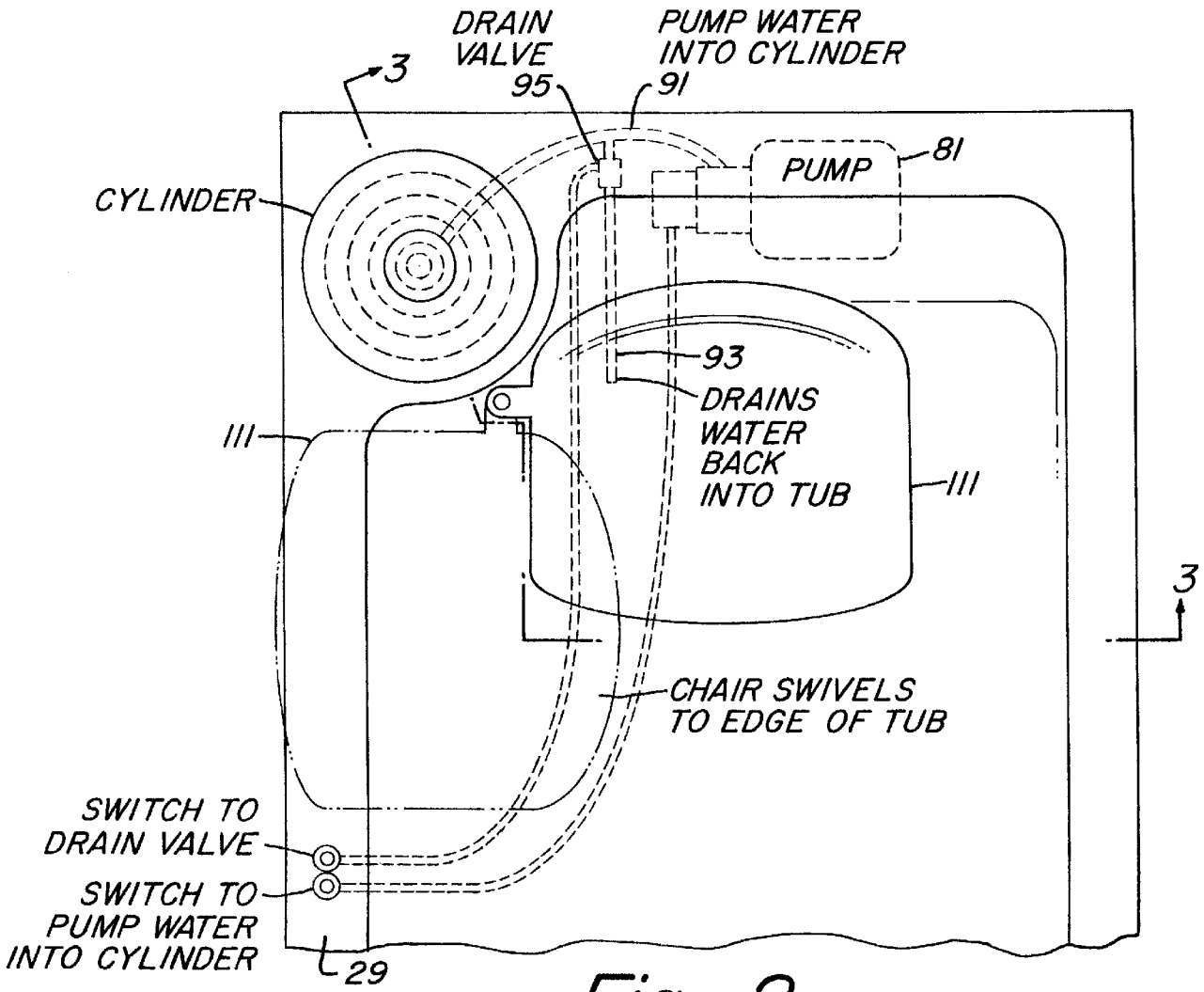
FIG. 2 is a partial top view of the chair lift of FIG. 1.
Figure 5:
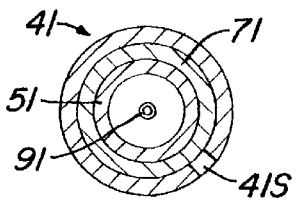
FIG. 5 is a cross-sectional view of FIG. 3 as seen along lines 5—5 thereof.

A chair 111 is provided for a person to be lowered into the water in the bathtub and raised from the water in the bathtub. A swivel connection 113 is coupled to the cylinder 51 and to the chair 111 and supports the chair 111 such that when the cylinder 51 moves downward, the connection 113 moves the chair downward and when the cylinder 51 moves upward, the connection 113 moves the chair 111 upward. The connection 113 comprises a member 115 connected to the cylinder 51 which extends through the slot 41S, and a member 117 pivotally connected to the member 115 and connected to the chair. The member 115 can move upward or downward in the slot 41S as herein will be described. When the chair 11 is in the position shown in FIG. 3, and when the cylinder 51 moves downward, member 115 moves downward in the slot 415S to move member 117 and hence the chair 111 downward. When the chair 111 is in the position shown in FIG. 6 and when the cylinder 51 moves upward, the member 115 moves upward in the slot 41S to move member 117 and hence the chair 111 upward. The two members 115 and 117 are pivotally coupled together by a pin 119 such that when the chair 11 is in an elevated position as shown in FIG. 3, it can be pivoted to a position above and next to the wall 29 as shown in dotted form in FIG. 2 to allow a person to get into the chair 111 or get out of the chair and hence out of the bathtub. If a person has gotten into the chair for bathing purposes, he or she can pivot the chair to the position as shown in FIG. 3 and in dark outline form in FIG. 2; open the valve 95 to drain the water out of the chamber 75 to lower the cylinder 51 which in turn lowers the chair into the bathtub. If the person wants to get out of the bathtub, the pump 81 can be started to pump water into the chamber 75 to raise the cylinder 51 which in turn raises the chair to the position as shown in FIG. 3. The person then can pivot the chair to the position as shown in a dotted form in FIG. 2 and get out of the chair onto the floor. The person can then pivot the chair to the position as shown in FIG. 3 and open the valve 95 to drain the water from the chamber 75 and lower the cylinder 51 and then the chair into the bathtub.

Referring to FIG. 7, there now will be described one system for controlling the pump 81 and drain 93. The pump 81 has a water inlet 87 extending from a source of water 89. The pump 81 has an electrical switch 81S which normally off such that electrical power from leads 83 and AC source 85 normally is not applied to the pump 81 such that it is off. The drain valve 95 also is normally off. A source 121 of air under pressure is coupled to the valve 95 and to the valve switch 81S by way of conduits 123 and 125 which include normally off valves 123V and 125V. When a person wants to operate the pump 81 to pump water from the source 81 to the chamber 75 to raise the cylinder 51 and hence the chair 111, the person can open the valve 125V to cause the air in conduit 125 to close the switch 81S to apply electrical power to the pump 81 from the source 85 by way of leads 83 to operate the pump 81 until the chair 111 is at the desired height at which time the valve 125V can be closed to open switch 81S to shut down the pump 81. Air in line 125 from valve 125V to switch 81S is exhausted by way of conduit 81E. When it is desired to drain the chamber 75 and to lower the cylinder 51 and hence the chair 111, the person can open the valve 123V to cause the air to open the valve 95 to drain the water from the chamber 75 into the bathtub by way of conduit 93 at which time the valve 123V can be closed which allows valve 95 to close. Air in line 123 from valve 123V to valve 95 is exhausted by way of conduit 95E.

Control of valves 123V and 125V can be carried out by a second person or by the person bathing by having the valves 123V and 125V located close to the bather.

By having cylinder 71 slidably located between cylinders 41 and 51, which are fixed to the bathtub, a very effective and stable support for the chair is provided. The use of the electric pump 81 allows the chair to be readily moved to an upper position.

In one embodiment, the cylinders 51 and 71 may be formed of PVC and the cylinder 41 may be formed of as suitable plastic such as layers of fiber glass with vertical metal strengthening rods bonded between the layers. The cylinders 51 and 41 will have their lower ends bonded to the plastic of the bathtub.

What is claimed is:

1. A bathtub and a chair lifting and lowering apparatus wherein said bathtub comprises wall structure and an upper edge, comprising:

a hollow stationary outer member having an outer wall with a given length, a lower portion and an upper portion, said lower portion being secured to said wall structure of said bathtub, and said upper portion extending above said upper edge of said bathtub, an inner stationary member secured to said wall structure of said bathtub, located in said lower portion of said outer wall and having an inner wall spaced inward from said outer wall, said inner wall having an upper end with an upper wall coupled to said upper end of said inner wall, a hollow movable member having a movable wall located between said inner and outer walls for movement between upper and lower positions inside of said outer wall, said movable wall having a closed upper end movable away from and toward said upper wall of said inner member defining a chamber with a variable volume between said upper wall of said inner member, and said movable wall and said closed end of said movable wall, water control means for injecting water into said chamber for moving said movable member to an upper position within said outer wall and for removing water from said chamber to allow said movable wall to move to a lower position, a slot formed through said outer wall along said given length, a chair having connection means extending through said slot and connected to said movable wall for moving said chair between an upper position relative to said bathtub and a lower position in said bathtub as said movable wall is moved between upper and lower positions.

2. The apparatus of claim 1, wherein said water control means comprises:

a pump having an inlet coupled to a source of water and an outlet coupled to said chamber for injecting water into said chamber.

3. A bathtub and a chair lifting and lowering apparatus wherein said bathtub comprises wall structure and an upper edge, comprising:

a hollow stationary outer member having an outer cylindrical wall with a given length, a lower portion and an upper portion, said lower portion being secured to said wall structure of said bathtub, and said upper portion extending above said upper edge of said bathtub, an inner stationary member secured to said wall structure of said bathtub, located in said lower portion of said outer cylindrical wall and having an inner cylindrical wall spaced inward from said outer cylindrical wall, said inner cylindrical wall having an upper end with an upper wall coupled to said upper end of said inner cylindrical wall, a hollow movable member having a movable cylindrical wall located between said inner and outer cylindrical walls for movement between upper and lower positions inside of said outer cylindrical wall, said movable cylindrical wall having a closed upper end movable away from and toward said upper wall of said inner member defining a chamber with a variable volume between said upper wall of said inner member, and said movable cylindrical wall and said closed end of said movable cylindrical wall, water control means for injecting water into said chamber for moving said movable member to an upper position within said outer cylindrical wall and for removing water from said chamber to allow said movable wall to move to a lower position, a slot formed through said outer cylindrical wall along said given length, a chair having connection means extending through said slot and connected to said movable cylindrical wall for moving said chair between an upper position relative to said bathtub and a lower position in said bathtub as said movable cylindrical wall is moved between upper and lower positions.

4. The apparatus of claim 3, wherein said water control means comprises:

a pump having an inlet coupled to a source of water and an outlet coupled to said chamber for injecting water into said chamber.

* * * * *